United States Patent [19]

Parker

[11] 4,022,464

[45] May 10, 1977

[54] DISPENSING CONTAINER AND CLOSURE

[75] Inventor: Keith Parker, Warrington, England

[73] Assignee: Dart Industries Inc., Los Angeles, Calif.

[22] Filed: Oct. 3, 1975

[21] Appl. No.: 619,272

[52] U.S. Cl. ..... 222/485

[51] Int. Cl.[2] ..... B65D 33/36

[58] Field of Search ..... 222/548, 480, 484–486, 222/565

[56] References Cited

UNITED STATES PATENTS

| | | | |
|---|---|---|---|
| 3,365,106 | 1/1968 | Lodding et al. | 222/485 |
| 3,405,850 | 10/1968 | Esposito, Jr. | 222/548 X |
| 3,467,288 | 9/1969 | Croyle | 222/480 |

*Primary Examiner*—Stanley H. Tollberg
*Assistant Examiner*—Norman L. Stack, Jr.
*Attorney, Agent, or Firm*—Kenneth J. Hovet; Leigh B. Taylor; Paul R. Wylie

[57] ABSTRACT

A package is provided having a rotatable closure equipped with dispensing orifices. The orifices overlie a neck portion having indentations spaced about its inner edge and which when aligned with the dispensing orifices provide access to the contents of the package. The closure includes an inner annular skirt which has axial slots about its outer periphery. The slots direct the flow of the container contents through the neck indentations and out the orifices when the closure is rotated to an open position. When the closure is in a closed position, the orifices will be located above flat areas on the top edge of the container neck.

The closure includes a downwardly depending inner wall having engagement means for rotatably connecting the closure to the container neck. The closure also includes an outer downwardly depending annular skirt located about the periphery of the closure and serving to provide a streamlined outward appearance for the overall package and to facilitate a user to grasp the closure and rotate it to an open or closed position.

10 Claims, 8 Drawing Figures

DISPENSING CONTAINER AND CLOSURE

BACKGROUND OF THE INVENTION

1. Field of the Invention

The present invention relates to dispensing packages having a rotatable closure and, more particularly, to a package having a closure which is sealingly attached to a container and which can be rotated to an open position for dispensing and a closed position for sealing the container contents.

2. Description of the Prior Art

It is highly advantageous in the packaging industry to provide a package which is economically produced while being simple and reliable in operation. To this end dispensing packages have been created in which a captive closure member cooperates with a container in a manner to seal the contents therein while permitting the product to be dispensed therefrom.

U.S. Pat. Nos. 3,297,214 and 3,389,840 and Great Britain Specification No. 1,199,705 are illustrative of dispensing packages wherein a closure cap may be rotated about a container neck to an open or closed position. This is convenient for the consumer in that one package can both seal the container contents for storage or dispense the contents by merely twisting a top cap. However, the aforementioned prior art have experienced difficulty in that the inner skirt portion of many of the closures were easily flexed allowing talc or other powdery materials typically contained within such packages to become clogged and/or wedged about the skirt portion. When such occurs, the package cannot be effectively sealed, nor can the contents be readily dispensed. Attempts to obviate this difficulty resulted in the use of camming structures which positively forced the slotted inner skirt portions outwardly thereby enlarging the access area and enhancing the dispensation of materials from the container. The problem with this technique is that on occasion the talc or other powdery material would cake and not flow back to the container, but remain squeezed between the skirt and container neck portion. In this manner the skirt would not return to its unflexed position and would aggravate the aforementioned clogging.

SUMMARY OF THE INVENTION

The present invention provides a dispensing package having a container with a round neck portion and a closure overlying the neck in axial alignment therewith. The neck includes an inner edge having circumferentially spaced apart indentations which align with slots on an annular depending inner ring section of the closure. The slots about the outer periphery of the ring are aligned with dispensing orifices through the closure top wall such that when the closure slots are oriented in axial alignment with the neck indentations, the container may be inverted and material will flow outwardly successively through the slots, indentations and dispensing orifices.

The closure includes a downwardly depending annular wall concentric with the ring and located radially outward from the dispensing orifices. The annular wall is provided with a circumferential ridge extending radially inwardly for cooperating engagement with an outwardly extending ridge on the container neck portion. The ridge on the neck portion is located axially from the top edge of the neck a distance slightly less than the axial distance between the ridge on the inner ring and the underside of the closure.

The container includes a tubular body portion terminating at its top end in an annular inwardly directed offset portion which merges into a shoulder portion integral with the aforementioned neck. The closure peripheral edge includes an outer downwardly depending skirt portion which, in a preferred embodiment, encloses the neck and shoulder portions thereby presenting a package having external body surfaces and closure outer surfaces which are coextensive.

DESCRIPTION OF THE PREFERRED EMBODIMENT

Figure 1:
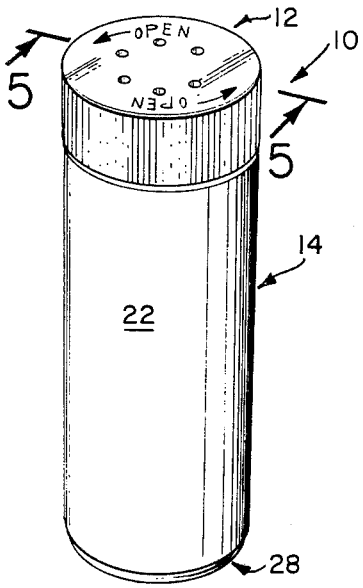
FIG. 1 is a perspective view of the dispensing package of the present invention.
Figure 2:
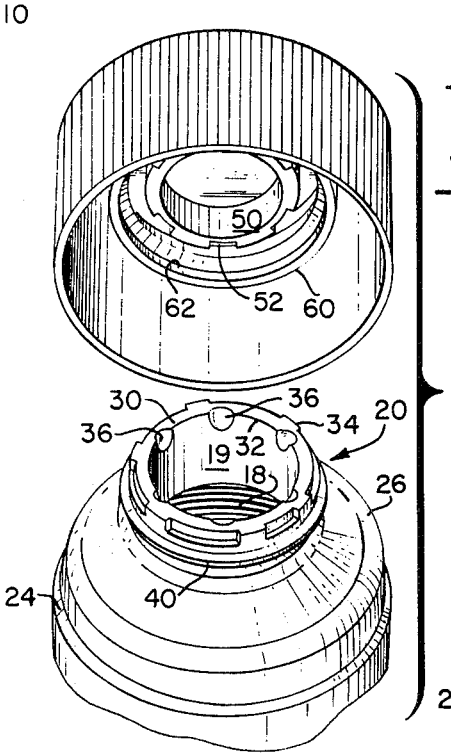
FIG. 2 shows an enlarged fragmentary exploded perspective view of the neck portion and closure of the package of FIG. 1.
Figure 3:
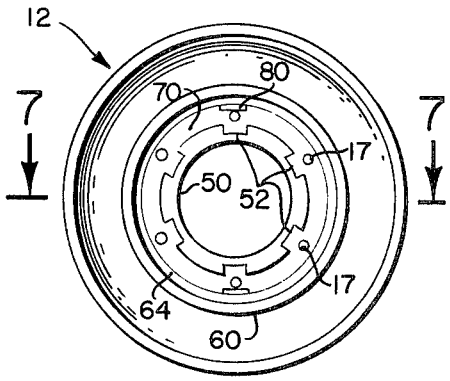
FIG. 3 shows a bottom plan view of the closure of FIG. 2.
Figure 4:
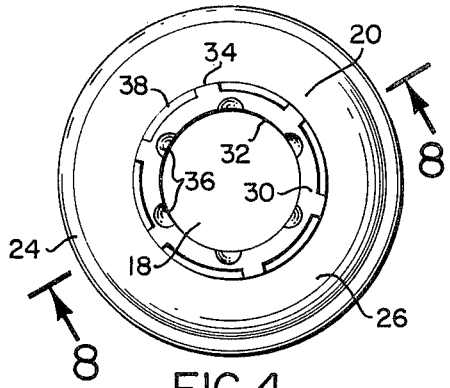
FIG. 4 shows a top plan view of the container and neck portion shown in FIG. 2.

Referring now to FIG. 1 of the drawings, there is shown a dispensing package 10 constructed in accordance with the present invention. The package includes a closure 12 and a container 14. The closure includes a top wall 16 which overlies an opening 18 through neck 20 when the closure and container are assembled in axial alignment. The top wall includes dispensing orifices 17 extending therethrough in a circular pattern. The axis of the pattern is in alignment with the longitudinal axis of the container is concentric with neck 20.

The container 14 is tubular in shape and with an upper end that terminates in an inwardly offset annular portion 24. The annular offset portion merges into a shoulder portion 26 which is inwardly inclined and merges into the neck 20. Although not shown, the container 14 includes an enclosed integral bottom portion 28.

The container neck 20 terminates in an annular flat top surface 30 underlying dispensing orifices 17. The top surface includes inner edge 32 and outer edge 34. The inner edge is provided with a plurality of indentations 36 circumferentially spaced apart a predetermined distance about said edge. The outer edge 34 is provided with one or more grooves 38 which are also circumferentially spaced apart about said edge. The grooves are elongated a distance at least about equal to the width of said indentations 36. The outer sidewall surface of neck 20 is provided with an engagement means 40. The engagement means preferably comprise an annular outwardly extending ridge 40 and is located in a manner which will be discussed hereinbelow.

Referring now to the closure 12, it will be noted that the top wall 16 includes an annular depending ring 50.

The outer wall surface of the ring 50 is provided with channels 52 which extend axially the length of the skirt and are circumferentially spaced apart about the ring outer surface a distance about equal to the distance between indentations 36. Preferably, the channels are in axial alignment with the dispensing orifices 17 and open toward each corresponding orifice. It will be appreciated that the ring 50 is substantially rigid and has a diameter slightly less than the diameter of the neck opening 18.

Located concentric with ring 50 is depending annular wall 60. The annular wall 60 is located radially outward from dispensing orifices 17. An annular ridge 64 extends inwardly from the inner sidewall 62. This ridge provides means for engagement with ridge 40 of neck 20.

It will be appreciated that the annular surface area 70 between the inner ring 40 and annular wall 60 is substantially planar. In this manner it will sealingly engage the flat top surface 30 of neck 20 when closure 12 is secured to the container by means of the aforementioned cooperating engagement means. To effect a tight connection and enhance the seal between the neck top edge and closure surface area, the outer annular ridge 40 is located axially from the neck top surface 30 a distance about slightly less than the axial distance between the inner annular ridge 64 and the top wall underside surface area 70. As shown, both of the ridges 40 and 64 are chamfered in cross sectional shape and are disposed horizontally such that the rotation of the closure 12 thereabout will also be horizontal. Of course, the slight difference of axial distances between ridges 40 and 64 effect an axial compression force which enhances the continued sealing engagement between the surface 30 and closure surface 70 regardless of the rotational position of the closure. It will also be appreciated that the annular wall 60 will flex outwardly slightly and thereby allow the closure 12 to be snapped on the neck during the assembly of the package.

Figure 5:
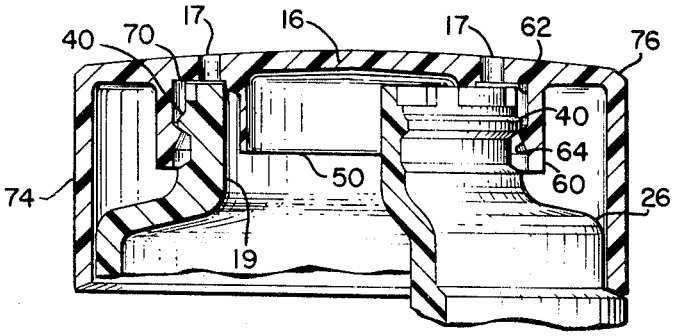
FIG. 5 is a fragmentary elevation cross-section view partially cut-away showing the neck and closure of FIG. 2 assembled with the closure in a closed position.
Figure 7:
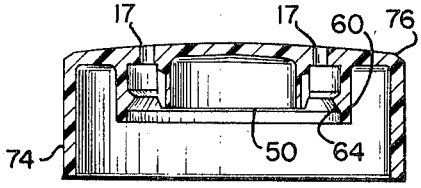
FIG. 7 is a cross-sectional elevation view of the closure of FIG. 2.
Figure 6:
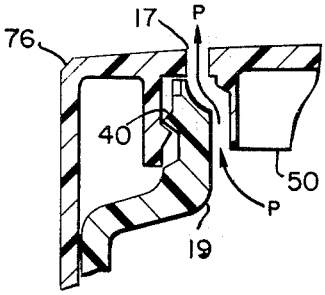
FIG. 6 is a fragmentary cross-sectional view showing a portion of the neck and closure of FIG. 2 assembled with the closure in an open position.
Figure 8:
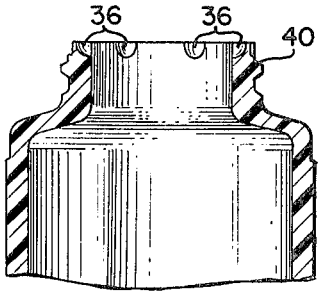
FIG. 8 is a fragmentary cross-sectional view taken along lines 8—8 of FIG. 4.

The closure 12 further includes an outer skirt 74 depending from the peripheral edge 76 of the top wall 16. In the preferred embodiment, the annular skirt 74 extends axially a distance from edge 76 to a point adjacent the annular offset portion 24 of container 14. It will be noted in FIG. 5 that the wall thickness of skirt 74 is slightly less than the radially offset distance of portion 24 and that the outer diameter of the skirt is about equal to the diameter of the tubular body 22. In this manner, when the closure 12 is assembled onto the container 14, a streamlined package will result with the other surface of skirt 74 being coextensive with the external surfaces of the tubular body 22.

It is preferred to limit the axial rotation of the closure to a full open position and a fully closed position. To effect this objective the closure is provided with at least one depending projection 80 extending from the annular surface 70 adjacent the inner surface of ring 60 about directly above grooves 38. The projection 80 depends axially from the surface 70 a distance somewhat less than the depth of the aforementioned grooves 38. When the closure is assembled on the neck, the projections 80 will freely move within the confines of the grooves 38, but the axial rotation will be stopped by the edge portions 34 existing between each of the grooves.

In operation it is contemplated that the container will be filled with a powdery material such as talcum powder or the like and that the closure will be aligned over the neck portion with the engagement means 40 and 64 snapping together connecting the closure to the filled container and thereby forming a complete two-piece dispensing package. In the closed position the dispensing orifices 17 will overlie the top surface 30 between indentations 36. When one wishes to dispense materials from within the container, the closure will be grasped about skirt 74 and rotated a distance until projection 80 engages at least one or more ends of grooves 38. In this position the orifices will be located about directly above indentations 36. The channels 52 being in alignment with the orifices, this open position allows access to the container interior. Upon inversion of the package the powder will gravity flow through the area between channel 52 and inner neck wall 19, through indentation 36 and out orifice 17. Note arrows referenced by capital P as indicating the path of materials flowing out the package.

Although it is contemplated the package of the present invention will be constructed of plastic materials, the substantially rigid ring 50 will not be flexed outwardly and allow powder or the like to be caked or packed thereabout to inhibit the dispensation of materials from the container. Note that the channels do not extend through the entire thickness of the ring. Still further it will be appreciated that the indentations 36 are preferrably hemispherical in shape which it has been found substantially inhibits the adherence of powders thereabout. Also, the present invention provides an effective sealing engagement between the neck edge and closure while still allowing relative rotation.

While the invention has been described with respect to preferred embodiments, it will be apparent to those skilled in the art that various modifications and improvements may be made without departing from the scope and spirit of the invention. Accordingly, it is to be understood that the invention is not to be limited by the specific illustrative embodiments, but only by the scope of the appended claims.

I claim:

1. A dispensing package comprising a container having a round neck portion with an opening providing access to the container interior and a closure having a top wall overlying said neck opening;

said neck portion terminating in a flat top surface having inner and outer concentric edges with said inner edge including a plurality of indentations spaced apart about the circumference thereof;

said closure including a plurality of dispensing orifices extending through said top wall and circumferentially spaced apart directly above said top surface a distance about equal to the distance between said indentations with an inner annular ring concentric with said dispensing orifices depending from said top wall radially inward from said dispensing orifices said ring presenting an imperforate continuous inner wall surface and an outer wall surface having a plurality of channels circumferentially spaced-apart a distance about equal to the distance between said orifices, said channel extending from a point proximate said top wall to the terminal end of said ring;

said closure being rotatable to an open position about said neck portion to locate said orifices above said indentations and in communication with the container interior and to a closed position whereby said orifices overlie said top surface thereby preventing dispensation of materials from the container interior.

2. The package of claim 1 wherein the outer edge of said top surface includes one or more circumferentially spaced apart peripheral grooves cooperating with one or more lugs depending from said top wall radially outward from said dispensing orifices, said lugs extending within said grooves whereby the axial rotation of said closure is limited by the circumferential length of said groove.

3. The package of claim 1 wherein said neck includes an outer annular ridge extending radially outward therefrom and said closure top wall includes a depending annular wall concentric with said inner skirt and located radially outward from said dispensing orifices, said annular wall having an inner ridge extending radially inwardly therefrom and adapted to engage the outer ridge of said neck to connect said closure to said container.

4. The package of claim 3 wherein said closure top wall terminates in a peripheral edge located radially outward from said annular wall, said edge having a depending annular outer skirt.

5. The package of claim 1 wherein the diameter of said dispensing orifices are no greater than the width of said neck portion top surface.

6. The package of claim 5 wherein said indentations are round in shape and have a diameter about at least equal to the diameter of said dispensing orifices.

7. The package of claim 6 wherein the annular surface area between said inner ring and said annular wall on the underside of said top wall is substantially planar and the outer annular ridge of said neck is spaced axially from the neck portion top surface a distance about slightly less than the axial distance between said inner annular ridge of said annular wall of said closure and said top wall underside surface area whereby said surface area is in sealing engagement with the neck portion top surface.

8. The package of claim 4 wherein said container includes a body portion having a diameter greater than the diameter of said neck, said body portion terminating in an annular inwardly offset portion which merges into an inclined shoulder portion integral with said neck.

9. The package of claim 8 wherein said annular outer skirt extends from said top wall peripheral edge to a point adjacent said offset portion.

10. The package of claim 9 wherein said body portion is tubular in shape and said closure top wall has a substantially flat top surface and is circular in shape having a diameter about equal to the diameter of said tubular body portion whereby the outer surfaces of said outer skirt and said body portion are coextensive.

* * * * *